US011313582B2

(12) United States Patent
Hayashi et al.

(10) Patent No.: US 11,313,582 B2
(45) Date of Patent: Apr. 26, 2022

(54) INDOOR UNIT OF AIR-CONDITIONING APPARATUS

(71) Applicant: Mitsubishi Electric Corporation, Tokyo (JP)

(72) Inventors: Tsuyoshi Hayashi, Tokyo (JP); Yuki Watanabe, Tokyo (JP); Masahide Kinami, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 320 days.

(21) Appl. No.: 16/099,566

(22) PCT Filed: Aug. 1, 2016

(86) PCT No.: PCT/JP2016/072482
§ 371 (c)(1),
(2) Date: Nov. 7, 2018

(87) PCT Pub. No.: WO2018/025302
PCT Pub. Date: Feb. 8, 2018

(65) Prior Publication Data

US 2019/0195529 A1 Jun. 27, 2019

(51) Int. Cl.
*F24F 13/20* (2006.01)
*F24F 1/0007* (2019.01)

(52) U.S. Cl.
CPC ..... *F24F 13/20* (2013.01); *F24F 1/0007* (2013.01); *F24F 2221/26* (2013.01)

(58) Field of Classification Search
CPC ..... F24F 13/10; F24F 1/0007; F24F 2221/26
(Continued)

(56) References Cited

U.S. PATENT DOCUMENTS

2016/0109162 A1* 4/2016 Suzuki ..... G01M 3/18 62/498

FOREIGN PATENT DOCUMENTS

CN 201507995 U * 6/2010 ..... F24F 1/00
JP H03-050385 U 5/1991
(Continued)

OTHER PUBLICATIONS

International Search Report of the International Searching Authority dated Aug. 30, 2016 for the corresponding international application No. PCT/JP2016/072482 (and English translation).
(Continued)

*Primary Examiner* — Avinash A Savani
*Assistant Examiner* — Dana K Tighe
(74) *Attorney, Agent, or Firm* — Posz Law Group, PLC

(57) ABSTRACT

An indoor unit of an air-conditioning apparatus includes a housing defining an outer shape of the indoor unit, and a pipe hole-opening groove section that is in a form of grid-like grooves on an inner surface of the housing. The housing has a box-like shape and includes a lower one surface panel forming a lower end of one side surface of the housing, a one end bottom panel forming one end of a bottom surface of the housing, a lower other surface panel forming a lower end of the other side surface of the housing, and the other end bottom panel forming the other end of the bottom surface of the housing. The pipe hole-opening groove section is formed in at least one of the lower one surface panel, the one end bottom panel, the lower other surface panel, and the other end bottom panel.

3 Claims, 7 Drawing Sheets

(58) Field of Classification Search
USPC ..... 454/233
See application file for complete search history.

(56) References Cited

FOREIGN PATENT DOCUMENTS

| | | | |
|---|---|---|---|
| JP | H11-051419 | A | 2/1999 |
| JP | 2002-349894 | A | 12/2002 |
| JP | 2012-052762 | A | 3/2012 |

OTHER PUBLICATIONS

Office Action dated Apr. 3, 2020 issued in corresponding CN patent application No. 201680087033.1 ( and English translation).
Extended European Search Report dated Jul. 16, 2019 issued in corresponding EP patent application No. 16911563.1.
Office Action dated Nov. 18, 2020 issued in corresponding CN patent application No. 201680087033.1 ( and English translation).

* cited by examiner

INDOOR UNIT OF AIR-CONDITIONING APPARATUS

CROSS REFERENCE TO RELATED APPLICATION

This application is a U.S. national stage application of PCT/JP2016/072482 filed on Aug. 1, 2016, the contents of which are incorporated herein by reference.

TECHNICAL FIELD

The present invention relates to an indoor unit of an air-conditioning apparatus including a pipe hole-opening groove section for forming a pipe passage.

BACKGROUND ART

A conventional indoor unit of an air-conditioning apparatus includes cutout plates each for pulling out a pipe for connection with an outdoor unit. The cutout plates are formed in lower right and left corners of a housing defining an outer shape of the indoor unit. Each cutout plate includes a groove-like cutout line along which the cutout plate is cut off from the housing. The cutout line is formed on an outer surface that is a design surface of the indoor unit. The point to pull out a pipe varies depending on an installation location of the indoor unit, and thus one of the cutout plates selected depending on the installation location is cut off. However, other cutout lines of the cutout plates left uncut are still present on the outer surface although the other cutout lines are no longer functionally necessary. The design of the indoor unit is thus degraded.

In view of the above, Patent Literature 1 discloses an indoor unit of an air-conditioning apparatus including a pipe hole-opening groove section that is arc-shaped to match the shape of a pipe and only formed on an inner surface of a housing of the indoor unit.

CITATION LIST

Patent Literature

Patent Literature 1: Japanese Unexamined Patent Application Publication No. 2002-349894

SUMMARY OF INVENTION

Technical Problem

The indoor unit of an air-conditioning apparatus disclosed in Patent Literature 1 allows a pipe hole-opening groove section unused for pipe connection to be hidden inside the housing, which is invisible from the outside, and the exterior design of the indoor unit can thus be improved. However, the indoor unit disclosed in Patent Literature 1 has a drawback in that cutting off this pipe hole-opening groove section along its edge with a cutting tool such as nippers is not work-efficient because an arced portion, in particular, of the pipe hole-opening groove section is difficult to cut. Moreover, it is difficult to beautifully cut off the pipe hole-opening groove section along its edge, and uncut burrs are so obtrusive as to degrade the design.

The prevent invention has been made to solve the above problems and aims to provide an indoor unit of an air-conditioning apparatus that allows not only to improve the exterior design of the indoor unit of an air-conditioning apparatus, but also to reduce the workload of cutting off a pipe hole-opening groove section while allowing the pipe hole-opening groove section to be beautifully cut.

Solution to Problem

An indoor unit of an air-conditioning apparatus of an embodiment of the present invention is connected to an outdoor unit with a pipe and includes a pipe hole-opening groove section that is in the form of grid-like grooves on an inner surface of a housing that defines an outer shape of the indoor unit.

Advantageous Effects of Invention

In an indoor unit of an air-conditioning apparatus of an embodiment of the present invention, a pipe hole-opening groove section that is in the form of grid-like grooves is formed on an inner surface of a housing defining an outer shape of the indoor unit, and a design surface (outer surface) of the housing is thus allowed to be flat without grooves. Also, a pipe hole-opening groove section unused for pipe connection is invisible from the outside, and the exterior design of the indoor unit is thus improved. Further, the grid-like grooves can be finely cut off with a cutting tool cell by cell in the grid, and the workload of cutting off the pipe hole-opening groove section is thus reduced. The pipe hole-opening groove section is thus also allowed to be beautifully cut, further improving the design.

DESCRIPTION OF EMBODIMENTS

Figure 1:
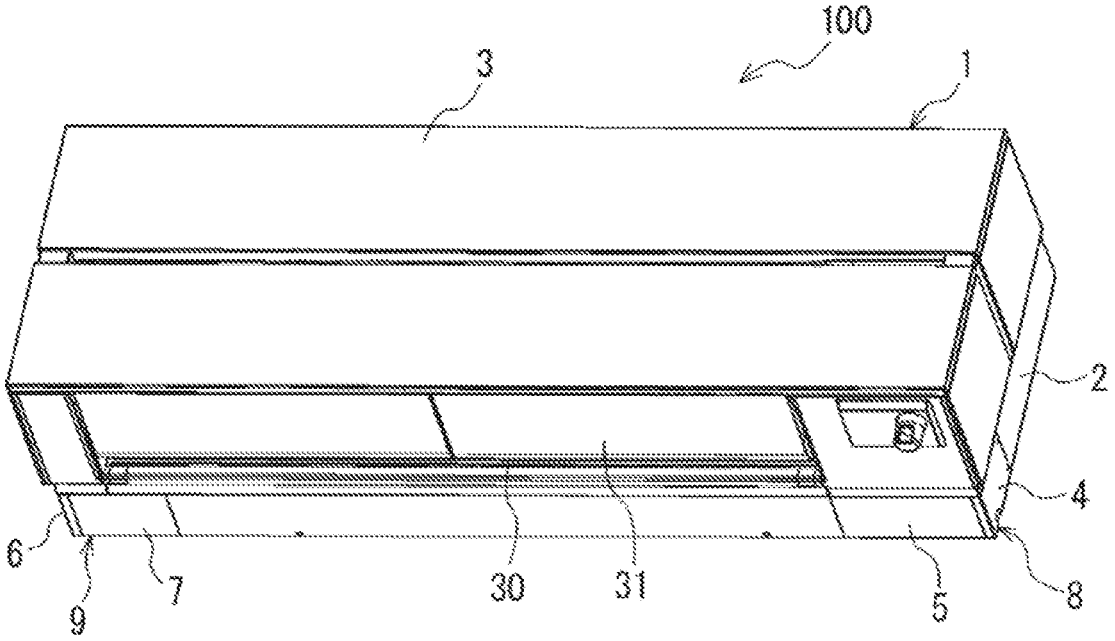
FIG. 1 is a bottom perspective view of an indoor unit of an air-conditioning apparatus according to Embodiment 1 of the present invention.

Embodiments of the present invention will be described hereinafter with reference to the drawings. In the drawings, the same or similar components are denoted by the same reference signs, and explanations of these components may be omitted or simplified as appropriate. The shape, size, locations, and other property of the components illustrated in the drawings may be changed as appropriate within the scope of the present invention.

Embodiment 1

FIG. 1 is a bottom perspective view of an indoor unit of an air-conditioning apparatus according to Embodiment 1 of the present invention. The indoor unit 100 shown in FIG. 1 is, for example, installed on a wall or other parts of a room for indoor air conditioning. The indoor unit 100 includes a housing 1 that defines an outer shape of the indoor unit 100. The indoor unit 100 further includes a heat exchanger, an air-sending fan, an electric component box, and other components, which are unillustrated, that are accommodated in the housing 1. The indoor unit 100 is connected to an outdoor unit, which is unillustrated, with a refrigerant pipe.

For example, the housing 1 is made of a rear case 2 and a front case 3 attached to the rear case 2, having a substantially cuboid box-like shape. The front case 3 includes an air outlet 30 provided with a wind direction adjuster 31 for adjusting a wind direction. Rotation of the air-sending fan causes indoor air to be suctioned into the indoor unit 100, and the suctioned air exchanges heat at the heat exchanger in the indoor unit 100. The air-conditioned air having exchanged heat is blown into the room from the air outlet 30.

The rear case 2 is provided with a lower right surface panel 4 and a right-end bottom panel 5 that are removable. The lower right surface panel 4 and the right-end bottom panel 5 form a part of the lower right corner of the housing 1. Also, the rear case 2 is provided with a lower left surface panel 6 and a left-end bottom panel 7 that are removable. The lower left surface panel 6 and the left-end bottom panel 7 form a part of the lower left corner of the housing 1. The lower right surface panel 4, the right-end bottom panel 5, the lower left surface panel 6, and the left-end bottom panel 7 may be provided to the front case 3.

Figure 2A:
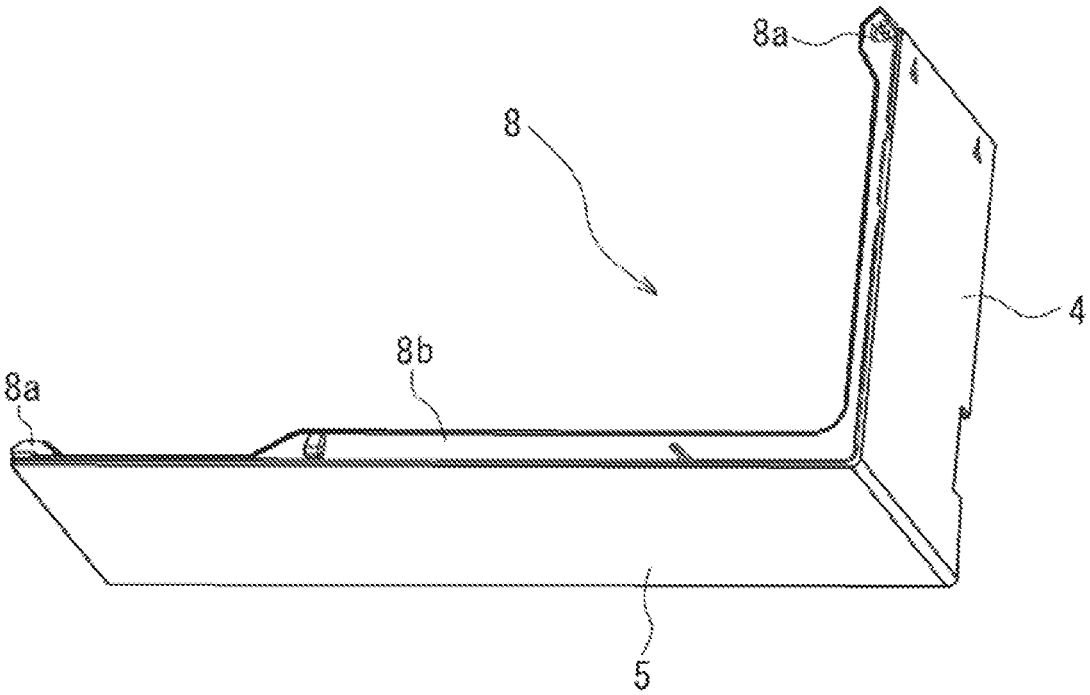
FIG. 2A is an outside perspective view of an L-shaped cover attached to a lower right corner of the indoor unit of the air-conditioning apparatus according to Embodiment 1 of the present invention.
Figure 2B:
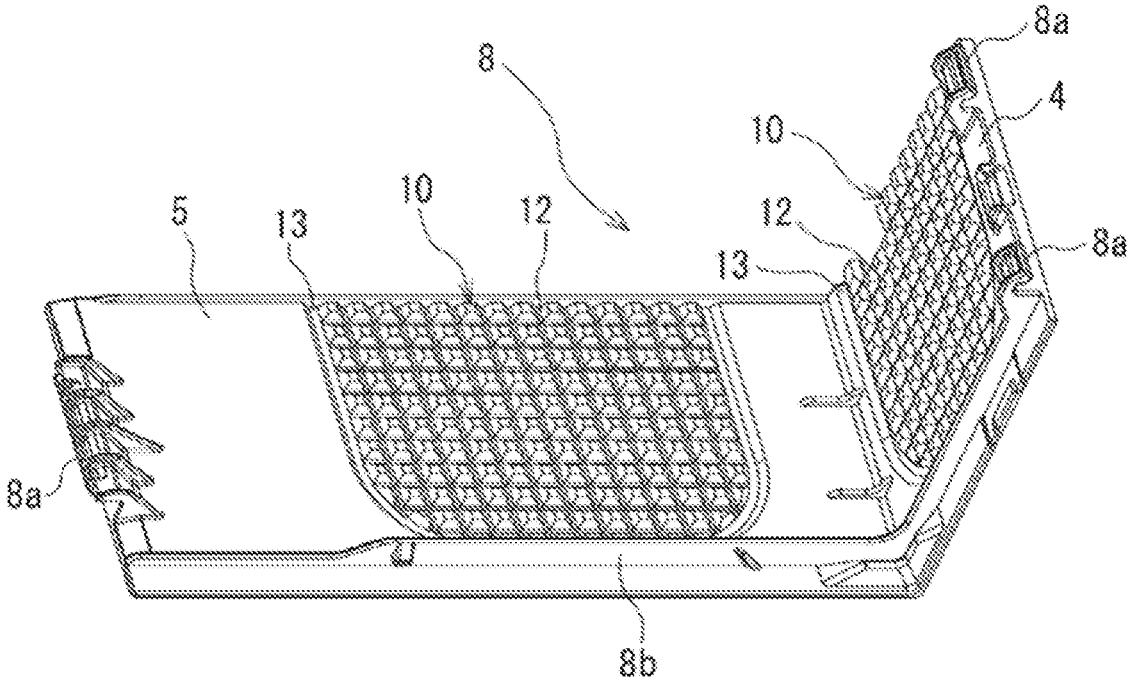
FIG. 2B is an inside perspective view of the L-shaped cover attached to the lower right corner of the indoor unit of the air-conditioning apparatus according to Embodiment 1 of the present invention.

FIG. 2A is an outside perspective view of an L-shaped cover attached to the lower right corner of the indoor unit of the air-conditioning apparatus according to Embodiment 1 of the present invention. FIG. 2B is an inside perspective view of the L-shaped cover attached to the lower right corner of the indoor unit of the air-conditioning apparatus according to Embodiment 1 of the present invention. As shown in FIG. 2A, the lower right surface panel 4 forms a lower end of the right surface of the housing 1. The right-end bottom panel 5 forms a right end of the bottom surface of the housing 1. The lower right surface panel 4 and the right-end bottom panel 5 are integrally formed as an L-shaped cover 8, and for example form a part of the lower right corner of the housing 1 that includes the right and bottom surfaces in a rear portion of the housing 1.

At each end of the lower right surface panel 4 and the right-end bottom panel 5, a mounting part 8*a* is provided for mounting on the rear case 2. In other words, the L-shaped cover 8 is mounted on the rear case 2 with the mounting parts 8*a* engaged with engaging parts, which are unillustrated, of the rear case 2. The L-shaped cover 8 is provided with a reinforcing rib 8*b* on one side surface of the L-shaped cover 8.

Figure 3A:
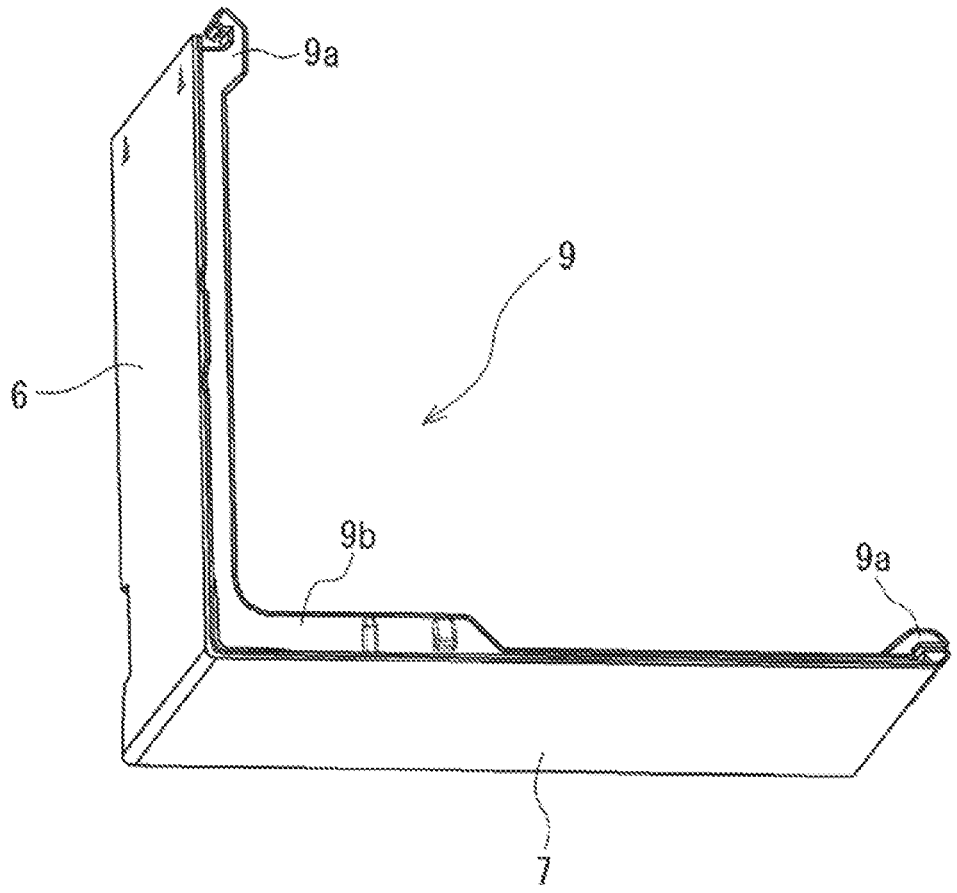
FIG. 3A is an outside perspective view of an L-shaped cover attached to a lower left corner of the indoor unit of the air-conditioning apparatus according to Embodiment 1 of the present invention.
Figure 3B:
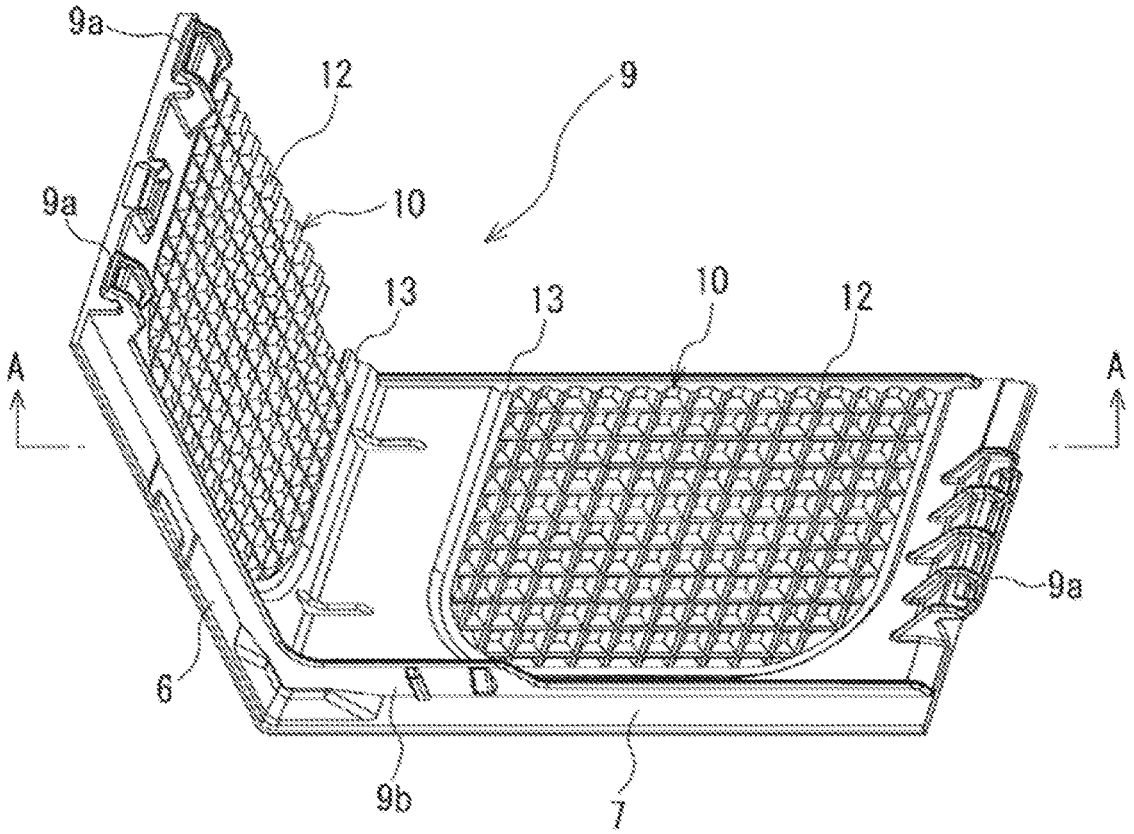
FIG. 3B is an inside perspective view of the L-shaped cover attached to the lower left corner of the indoor unit of the air-conditioning apparatus according to Embodiment 1 of the present invention.

FIG. 3A is an outside perspective view of an L-shaped cover attached to the lower left corner of the indoor unit of the air-conditioning apparatus according to Embodiment 1 of the present invention. FIG. 3B is an inside perspective view of the L-shaped cover attached to the lower left corner of the indoor unit of the air-conditioning apparatus according to Embodiment 1 of the present invention. The lower left surface panel 6 forms a lower end of the left surface of the housing 1. The left-end bottom panel 7 forms a left end of the bottom surface of the housing 1. The lower left surface panel 6 and the left-end bottom panel 7 are integrally formed as an L-shaped cover 9, and for example form a part of the lower left corner of the housing 1 that includes the left and bottom surfaces in the rear portion of the housing 1.

At each end of the lower left surface panel 6 and the left-end bottom panel 7, a mounting part 9*a* is provided for mounting on the rear case 2. In other words, the L-shaped cover 9 is mounted on the rear case 2 with the mounting parts 9*a* engaged with engaging parts, which are unillustrated, of the rear case 2. The L-shaped cover 9 is provided with a reinforcing rib 9*b* on one side surface of the L-shaped cover 9.

As shown in FIGS. 2B and 3B, the indoor unit 100 of Embodiment 1 includes a pipe hole-opening groove section 10 on each inner surface of the lower right surface panel 4, the right-end bottom panel 5, the lower left surface panel 6, and the left-end bottom panel 7. The pipe hole-opening groove section 10 is for opening a pipe hole through which a pipe for connection with the outdoor unit is pulled out. Cutting off this pipe hole-opening groove section 10 with nippers or any other cutting tool forms a pipe passage 11 for a pipe that connects the indoor unit 100 and the outdoor unit. That is, the indoor unit 100 of Embodiment 1 has a flat outer surface unprovided with grooves for forming the pipe passage 11, as shown in FIGS. 2A and 3A.

The pipe hole-opening groove section 10 is made of a groove-like outer frame 13 and grid-like grooves 12 cut within the outer frame 13. The grid-like grooves 12 have a thickness thinner than the other parts of the panel, and can be easily cut with a cutting tool. As shown in FIGS. 2B and 3B, the pipe hole-opening groove section 10 is formed in such a manner that one side of the outer frame 13 corresponds to an edge of the L-shaped cover 8 or 9 to allow for entry of the cutting tool. Two sides of the outer frame 13 of the pipe hole-opening groove section 10 may correspond to edges of the L-shaped cover 8 or 9, although detailed illustration is omitted.

Figure 4:
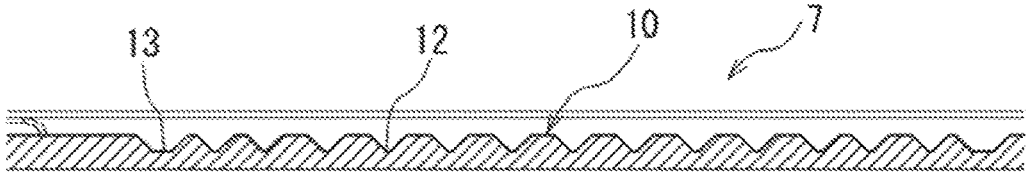
FIG. 4 is an enlarged cross-sectional view taken along the line A-A of FIG. 3B.
Figure 5A:
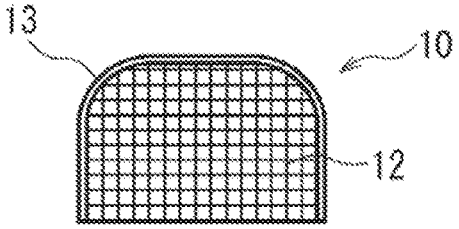
FIG. 5A is a schematic plan view illustrating a pipe hole-opening groove section of the indoor unit of the air-conditioning apparatus according to Embodiment 1 of the present invention.

FIG. 4 is an enlarged cross-sectional view taken along the line A-A of FIG. 3B. FIG. 5A is a schematic plan view illustrating the pipe hole-opening groove section of the indoor unit of the air-conditioning apparatus according to Embodiment 1 of the present invention. As shown in FIG.

5A, the groove-like outer frame 13 has a substantially square shape with inwardly arced upper corners. The groove-like outer frame 13 is shaped to match an outer shape of a pipe. As shown in FIG. 4, the outer frame 13 has an inverted trapezoidal cross section with a bottom of approximately 3 mm to 5 mm and outwardly slanting groove walls. The plate thickness of the part corresponding to the outer frame 13 is approximately 1 mm to 1.5 mm for example, which is thin enough to allow the outer frame 13 to be easily cut with the cutting tool. For example, the outer frame 13 measures 4 cm in height and 5.5 cm in width to allow a pipe to run through the outer frame 13.

Figure 5B:
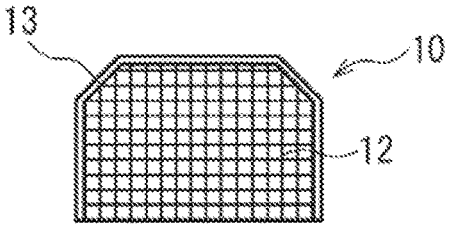
FIG. 5B is a schematic plan view illustrating the pipe hole-opening groove section having a differently shaped outer frame.
Figure 5C:
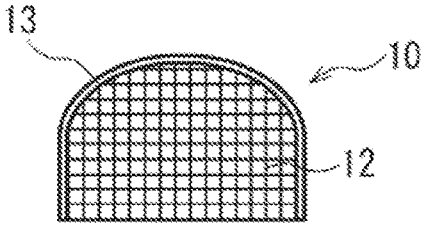
FIG. 5C is a schematic plan view illustrating the pipe hole-opening groove section having a differently shaped outer frame.
Figure 5D:
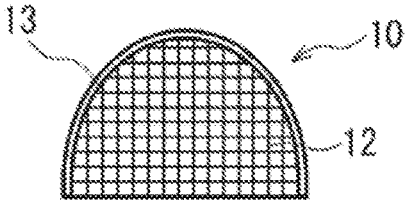
FIG. 5D is a schematic plan view illustrating the pipe hole-opening groove section having a differently shaped outer frame.

FIGS. 5B to 5D are plan views each illustrating the pipe hole-opening groove section having a differently shaped outer frame. The shape of the outer frame 13 of the pipe hole-opening groove section 10 is not limited to that shown in FIG. 5A. For example, the outer frame 13 may have a polygonal shape with diagonal upper corners (FIG. 5B), a shape with an arched upper portion (FIG. 5C), or a semi-circular shape (FIG. 5D). That is, the outer frame 13 is only required to be sized and shaped to allow a pipe to run through the outer frame 13, and may be modified in accordance with actual usage conditions.

As shown in FIGS. 2B and 3B, the grid-like grooves 12 are made of vertical grooves and horizontal grooves perpendicularly intersecting each other to form rectangles. The groove width of each of the grid-like grooves 12 is, for example, approximately 1 mm to allow for entry of a blade of the cutting tool into the groove. An interval between two adjacent grooves of the grid-like grooves 12 is, for example, approximately 3 mm to 5 mm. The groove width and the interval of the grid-like grooves 12 may be changed as appropriate depending on the size of the housing 1. As shown in FIG. 4, each of the grid-like grooves 12 is shaped in a V-groove with outwardly slanting groove walls to allow for easy entry of a blade of the cutting tool into the groove. Shaping each of the grid-like grooves 12 in a V-groove allows the grid-like grooves 12 to be easily cut with the cutting tool because a stress applied by the blade of the cutting tool entering the groove concentrates on the valley of the V-groove. However, the shape of each of the grid-like grooves 12 is not limited to the V-groove, and may be a rectangular groove or a trapezoidal groove. Note that an upper surface of a part surrounded by the grid-like grooves 12 lies flush with the inner surface of the L-shaped cover 8 or 9. The plate thickness of the part corresponding to the grid-like grooves 12 of the pipe hole-opening groove section 10 is approximately 1 mm to 1.5 mm for example, which is thin enough to allow the grid-like grooves 12 to be easily cut off with the cutting tool such as nippers.

Figure 6A:
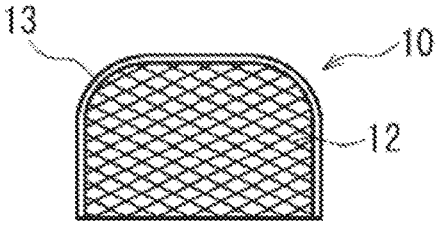
FIG. 6A is a schematic plan view illustrating the pipe hole-opening groove section having grid-like grooves of a different shape.
Figure 6B:
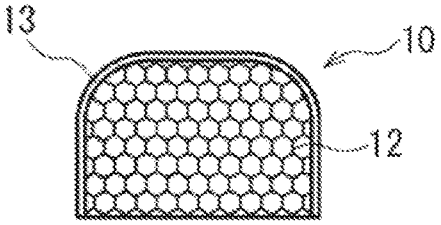
FIG. 6B is a schematic plan view illustrating the pipe hole-opening groove section having grid-like grooves of a different shape.

FIGS. 6A and 6B are schematic plan views each illustrating the pipe hole-opening groove section having grid-like grooves of a different shape. As shown in FIG. 6A, the grid-like grooves 12 may be made of inclined grooves intersecting each other to form a diamond grid. Alternatively, as shown in FIG. 6B, the grid-like grooves 12 may form a honeycomb grid. That is, the shape of the grid is not limited to the rectangular grid shown in FIGS. 2B and 3B, and may be any of various forms.

Figure 7:
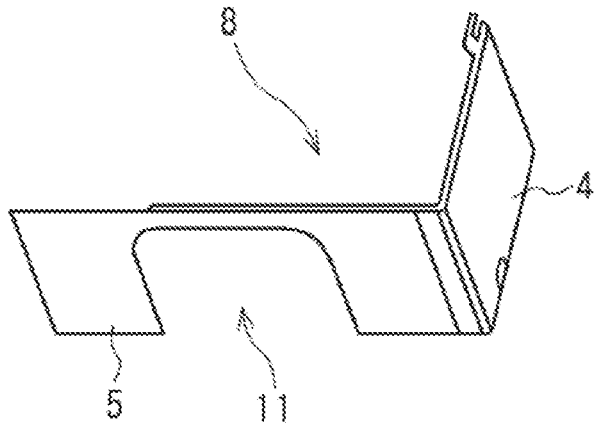
FIG. 7 is a perspective view of the L-shaped cover provided with a pipe passage.

A brief explanation will be given of a procedure to form the pipe passage 11 by cutting off the pipe hole-opening groove section 10. FIG. 7 is a perspective view of the L-shaped cover provided with the pipe passage. First, an operator removes from the rear case 2 the L-shaped cover 8 having a panel required for forming the pipe passage 11, which is one of the lower right surface panel 4, the right-end bottom panel 5, the lower left surface panel 6, and the left-end bottom panel 7. In the example shown in FIG. 7, the pipe passage 11 is formed in the right-end bottom panel 5, and a pipe for connection with the outdoor unit is pulled out from the right end of the bottom surface. Then, the operator holds the removed L-shaped cover 8 and enters a blade of the cutting tool into the grid-like grooves 12 from the edge of the pipe hole-opening groove section 10 to cut off the grid finely cell by cell. As shown in FIG. 7, the operator cuts off the grid-like grooves 12 along the outer frame 13 to form the pipe passage 11, and then reattaches the L-shaped cover 8 to the rear case 2. When the pipe for connection with the outdoor unit is pulled out from the rear portion of the housing 1, there is no need to form the pipe passage 11 in any of the lower right surface panel 4, the right-end bottom panel 5, the lower left surface panel 6, and the left-end bottom panel 7.

Figure 8:
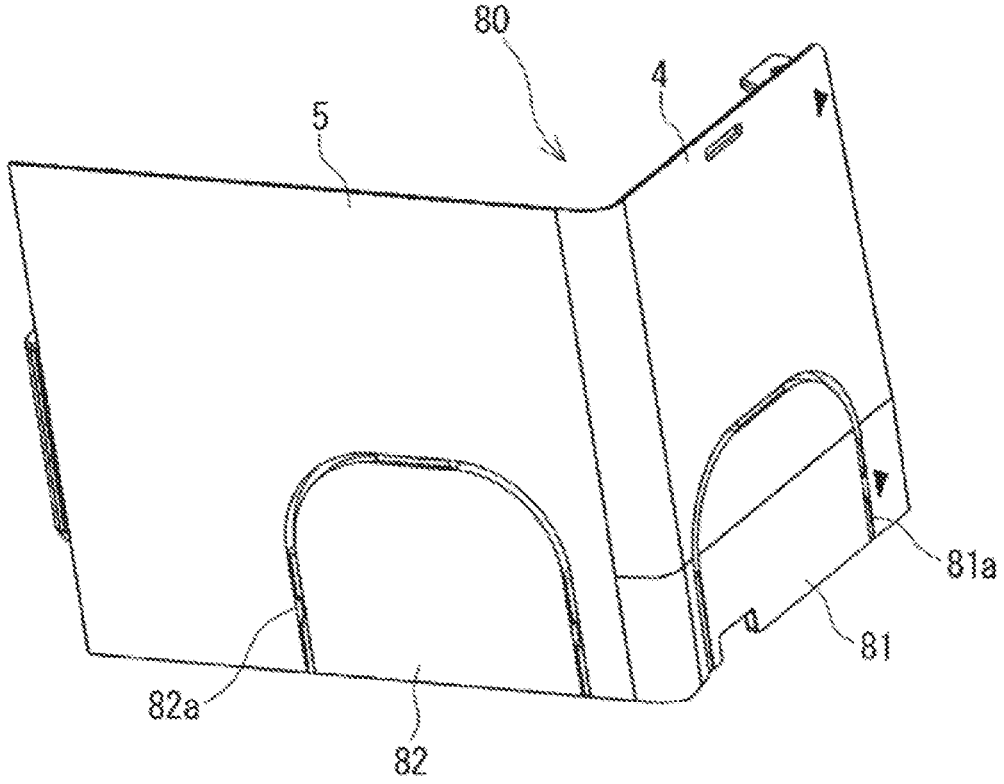
FIG. 8 Related Art
FIG. 8 is a perspective view of an L-shaped cover of a conventional indoor unit of an air-conditioning apparatus.

FIG. 8 is a perspective view of an L-shaped cover of a conventional indoor unit of an air-conditioning apparatus. An L-shaped cover 80 shown in FIG. 8 is also made of the lower right surface panel 4 and the right-end bottom panel 5 that are integrally formed as the L-shaped cover 80. The L-shaped cover 80 includes a first cutout plate 81 and a second cutout plate 82 each for pulling out a pipe for connecting the indoor unit and the outdoor unit. In the case of pulling out the pipe through the surface having the first cutout plate 81, the pipe is pulled out through a hole opened by cutting off the first cutout plate 81. In the case of pulling out the pipe through the surface having the second cutout plate 82, the pipe is pulled out through a hole opened by cutting off the second cutout plate 82. The L-shaped cover 80 shown in FIG. 8 includes a groove-like first cutout line 81*a* for cutting off the first cutout plate 81, and a groove-like second cutout line 82*a* for cutting off the second cutout plate 82. The first cutout line 81*a* and the second cutout line 82*a* are present on the design surface of the indoor unit even when the pipe is not pulled out through the surface having the first cutout line 81*a* or the second cutout line 82*a*. Thus, the indoor unit to which the L-shaped cover 80 shown in FIG. 8 is attached may degrade the design of the indoor unit.

On the other hand, the indoor unit of the air-conditioning apparatus of Embodiment 1 includes the pipe hole-opening groove section 10 formed as the grid-like grooves 12 on the inner surface of the housing 1 defining the outer shape of the indoor unit. The design surface (outer surface) of the housing 1 is thus allowed to be flat without grooves. Also, the pipe hole-opening groove section 10 that is unused for pipe connection is invisible from the outside, and the exterior design of the indoor unit is thus improved. Further, the grid-like grooves 12 can be finely cut off with a cutting tool cell by cell in the grid, and the workload of cutting off the pipe hole-opening groove section 10 is thus reduced.

Further, the pipe hole-opening groove section 10 is formed in at least one of the lower right surface panel 4, the right-end bottom panel 5, the lower left surface panel 6, and the left-end bottom panel 7. An operator is thus allowed to remove from the rear case 2 a panel that is required for forming the pipe passage 11 and to do the cutting work at hand, reducing the workload of the cutting work.

Further, the pipe hole-opening groove section 10 is made of the grid-like grooves 12 that are cut within the groove-like outer frame 13. The pipe passage 11 is thus allowed to be beautifully formed along the outer frame 13, further improving the design.

Embodiment 2

Figure 9:
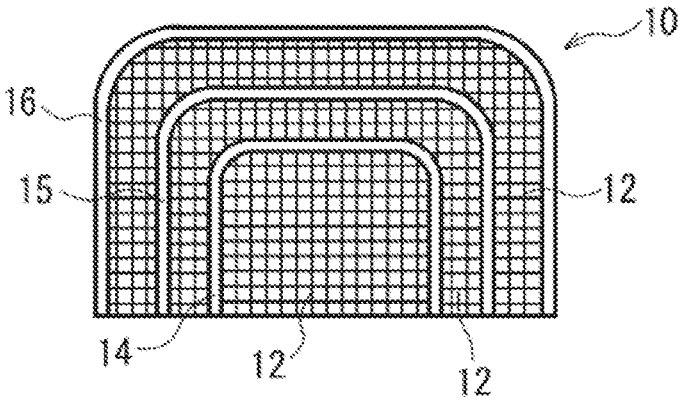
FIG. 9 is a schematic plan view illustrating the pipe hole-opening groove section of the indoor unit of the air-conditioning apparatus according to Embodiment 2 of the present invention.

The indoor unit of the air-conditioning apparatus according to Embodiment 2 will be explained with reference to FIG. 9. FIG. 9 is a schematic plan view illustrating the pipe hole-opening groove section of the indoor unit of the air-conditioning apparatus according to Embodiment 2 of the present invention. The same components as those of the indoor unit 100 of the air-conditioning apparatus of Embodiment 1 are denoted by the same reference signs, and explanations of these components are omitted as appropriate.

The indoor unit 100 of the air-conditioning apparatus of Embodiment 2 is the same as the indoor unit of the above Embodiment 1 in that the pipe hole-opening groove section 10 is formed on the inner surface of each of the lower right surface panel 4, the right-end bottom panel 5, the lower left surface panel 6, and the left-end bottom panel 7. The pipe hole-opening groove section 10 of the indoor unit 100 of Embodiment 2 includes a groove-like first outer frame 14, a groove-like second outer frame 15, and a groove-like third outer frame 16 each having a different size. The first outer frame 14, the second outer frame 15, and the third outer frame 16 are spaced from each other in such a manner that a larger one of the outer frames encloses a smaller one of the outer frames in turn. The grid-like grooves 12 are cut within each of areas surrounded by the first outer frame 14, the second outer frame 15, and the third outer frame 16. That is, the pipe hole-opening groove section 10 shown in FIG. 8 includes the outer frames 14 to 16 that are differently sized depending on a diameter of a pipe. FIG. 8 exemplarily shows the pipe hole-opening groove section 10 including three outer frames, but more than one outer frame is only required. Alternatively, the first outer frame 14, the second outer frame 15, and the third outer frame 16 may be each formed in such a manner that a width of some grooves of the grid-like grooves 12 are enlarged.

Thus, the indoor unit 100 of the air-conditioning apparatus of Embodiment 2 is allowed to form the pipe passage 11 of an appropriate size by selecting one of the outer frames 14 to 16 depending on the outer diameter of the pipe. In other words, the indoor unit 100 of the air-conditioning apparatus of Embodiment 2 does not require forming the pipe passage 11 that is unnecessarily larger than the outer diameter of the pipe, and both the design effect and the quality of the cutting work are thus improved. Of course, the grid-like grooves 12 can be finely cut off with a cutting tool cell by cell in the grid, and the workload of cutting off the pipe hole-opening groove section 10 is thus reduced. The grid-like grooves 12 can also be beautifully cut along the outer frame 13, which leads to improved design.

The indoor unit 100 of the air-conditioning apparatus of Embodiment 2 includes the pipe hole-opening groove section 10 formed as the grid-like grooves 12 on the inner surface of the housing 1 defining the outer shape of the indoor unit 100. The design surface (outer surface) of the housing 1 is thus allowed to be flat without grooves. Also, the pipe hole-opening groove section 10 that is unused for pipe connection is invisible from the outside, and the exterior design of the indoor unit s thus improved.

The present invention has been explained with reference to the embodiments, but the present invention is not limited to the above embodiments. For example, although the pipe hole-opening groove section 10 is formed on each inner surface of the lower right surface panel 4, the right-end bottom panel 5, the lower left surface panel 6, and the left-end bottom panel 7 in Embodiments 1 and 2, the pipe hole-opening groove section 10 may be formed in at least one of the lower right surface panel 4, the right-end bottom panel 5, the lower left surface panel 6, and the left-end bottom panel 7. Further, the pipe hole-opening groove section 10 is only required to be formed on the inner surface of the housing 1, and thus the pipe hole-opening groove section 10 is not limited to that formed in the lower right surface panel 4, the right-end bottom panel 5, the lower left surface panel 6, or the left-end bottom panel 7. In other words, various modifications, applications and usages made by those skilled in the art as necessary are included in the gist (technical scope) of the present invention.

REFERENCE SIGNS LIST

1 housing 2 rear case 3 front case 4 lower right surface panel

5 right-end bottom panel 6 lower left surface panel 7 left-end bottom panel 8, 9 L-shaped cover 8*a*, 9*a* mounting part 8*b*, 9*b* rib 10 pipe hole-opening groove section 11 pipe passage 12 grid-like groove 13 outer frame 14 first outer frame 15 second outer frame 16 third outer frame

30 air outlet 31 wind direction adjuster 80 L-shaped cover 81 first cutout plate 81*a* first cutout line 82 second cutout plate 82*a* second cutout line 100 indoor unit

The invention claimed is:

1. An indoor unit of an air-conditioning apparatus connected to an outdoor unit with a pipe, the indoor unit comprising:

a housing defining an outer shape of the indoor unit, wherein:

the housing includes a pipe-hole opening section, including grid-like grooves formed on an inner surface of the pipe hole-opening section, the grid-like grooves are cut within a groove-like outer frame further formed on the inner surface of the pipe hole-opening section, and an outer surface of the pipe hole-opening section that is opposite to the inner surface of the pipe hole-opening section is a flat surface that is without grid-like grooves.

2. The indoor unit of an air-conditioning apparatus of claim 1, wherein the housing has a box-like shape and includes a lower one surface panel forming a lower end of one side surface of the housing, a one end bottom panel forming one end of a bottom surface of the housing, a lower other surface panel forming a lower end of an other side surface of the housing, and an other end bottom panel forming an other end of the bottom surface of the housing, and wherein the pipe hole-opening section is formed in at least one of the lower one surface panel, the one end bottom panel, the lower other surface panel, and the other end bottom panel.

3. The indoor unit of an air-conditioning apparatus of claim 1, wherein the groove-like outer frame is a plurality of groove-like outer frames each having a different size, the plurality of groove-like outer frames being spaced from each other in such a manner that a larger one of the plurality of groove-like outer frames encloses a smaller one of the plurality of groove-like outer frames in turn, and wherein the grid-like grooves are cut within each of the plurality of groove-like outer frames.

* * * * *